US006814051B2

(12) United States Patent
Suzuki

(10) Patent No.: US 6,814,051 B2
(45) Date of Patent: Nov. 9, 2004

(54) THROTTLE VALVE SYSTEM FOR INTERNAL COMBUSTION ENGINE

(75) Inventor: Yasuhiro Suzuki, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/648,246

(22) Filed: Aug. 27, 2003

(65) Prior Publication Data

US 2004/0040536 A1 Mar. 4, 2004

(30) Foreign Application Priority Data

Aug. 29, 2002 (JP) ..... 2002-250438

(51) Int. Cl.[7] ..... F02D 9/10; F02D 33/10; F02M 35/10

(52) U.S. Cl. ..... 123/337; 251/305

(58) Field of Search ..... 123/337; 251/305

(56) References Cited

U.S. PATENT DOCUMENTS 5,704,335 A 1/1998 Akutagawa et al. ..... 123/337

6,408,817 B2 * 6/2002 Torii et al. ..... 123/337

2004/0041117 A1 * 3/2004 Suzuki ..... 251/305

* cited by examiner

*Primary Examiner*—Weilun Lo

(74) *Attorney, Agent, or Firm*—Nixon & Vanderhye P. C.

(57) ABSTRACT

A bore portion of a throttle body of a throttle valve is formed in double-tube structure. In the double-tube structure, a central axis of a cylindrical inner bore tube is deviated downward from a central axis of a cylindrical outer bore tube in order to prevent water from entering an air inlet port or an air outlet port of a bypass. A valve body of an ISC valve (an idling speed control valve) controls an opening degree of the bypass. A trapping concavity on a bypass side has larger internal volume than on a side opposite from the bypass. Thus, the bore portion of the throttle body can be downsized. Meanwhile, performance for preventing icing of the throttle valve can be improved.

7 Claims, 9 Drawing Sheets

THROTTLE VALVE SYSTEM FOR INTERNAL COMBUSTION ENGINE

CROSS REFERENCE TO RELATED APPLICATION

This application is based on and incorporates herein by reference Japanese Patent Application No. 2002-250438 filed on Aug. 29, 2002.

BACKGROUND OF THE INVENTION

1. Field of the Invention

The present invention relates to a throttle valve system of an internal combustion engine capable of preventing freezing of a throttle valve. More specifically, the invention relates to the throttle valve system having a function for preventing the freezing of the throttle valve, which is caused by water coming along an inner peripheral surface of an intake pipe from an upstream side of the throttle valve during a cold period such as a winter season. The present invention also relates to downsizing of a bore portion of a throttle body, in which the throttle valve is accommodated and held rotatably.

2. Description of Related Art

In a cold period such as a winter season, PCV water enters a bore portion 102 of a throttle body from an upstream side of a throttle valve 101 along an inner peripheral surface of an intake pipe and is trapped at a blocked position of the throttle valve 101 as shown in FIG. 13. Then, the PCV water is frozen there. The PCV water is, for example, water flowing from a positive crankcase ventilation system into the intake pipe through an outlet port located upstream of the throttle valve 101. As a result, malfunction of an internal combustion engine may be caused. Therefore, a throttle valve system for overcoming such a problem has been proposed.

For instance, in a throttle valve system disclosed in Japanese Patent Unexamined Publication No. H09-32590 (Pages 3 to 5, FIGS. 1 and 2), a bore portion 202 of a throttle body has double-tube structure, in which an inner bore tube 212 and an outer bore tube 211 are integrally formed of heat-resistant resin, as shown in FIG. 14. The inner bore tube 212 is formed inside the outer bore tube 211 concentrically with the outer bore tube 211. A longitudinal length of the inner bore tube 212 in a direction of intake-air flow is a little shorter than that of the outer bore tube 211. The inner bore tube 212 forms an intake air passage 203. A throttle valve 201 is installed through a shaft at the middle of the longitudinal length of the inner bore tube 212. An annular disk-like partition wall 204 is disposed between the outer bore tube 211 and the inner bore tube 212 through an entire circumference nearly at the middle of the longitudinal length of the inner bore tube 212 in a flat plane perpendicular to the intake-air flow direction. Thus, the partition wall 204 divides an annular space formed between the outer bore tube 211 and the inner bore tube 212 into upstream and downstream trapping concavities (water trapping grooves) 221, 222 for trapping the upstream PCV water flowing into the outer bore tube 211 of the throttle body along the inner peripheral surface of the intake pipe.

As explained above, in the conventional throttle valve system shown in FIG. 14, the central axis of the outer bore tube 211 is arranged concentrically with the central axis of the inner bore tube 212. Furthermore, the annular space between the outer bore tube 211 and the inner bore tube 212 is separated by the annular disk-like partition wall 204 through the entire circumference. Therefore, the trapping concavities 221, 222 are provided with uniform radial width throughout the circumference. Consequently, there arises such a problem that the radial size of the bore portion 202 of the throttle body increases, so the bore portion 202 is upsized.

In addition, a flowing pattern or flowing quantity of the water flowing from the upstream side or the downstream side of the throttle valve varies in accordance with a layout of an intake system of a vehicle, a mounting position of an idling speed control valve (ISC valve), and a mounting position of the throttle body to the vehicle. The ISC valve is used for controlling the idling rotation speed of the engine by regulating the quantity of air flowing through a bypass of the throttle valve. Therefore, trapping concavities having required size should be preferably provided in optimum positions in accordance with the flowing condition of the water flowing into the throttle body.

SUMMARY OF THE INVENTION

It is therefore an object of the present invention to provide a throttle valve system of an internal combustion engine capable of providing a space, an annular space or a trapping concavity having a required size at an optimum position in accordance with flowing condition of water flowing into a throttle body. It is therefore another object of the present invention to provide a throttle valve system of an internal combustion engine capable of preventing freezing of the throttle valve without introducing engine cooling water, while downsizing the throttle body.

According to an aspect of the present invention, a throttle body has double-tube structure, in which an outer bore tube radially surrounds an outer peripheral surface of an inner bore tube. The inner bore tube accommodates a throttle valve so. that the throttle valve can open or close. The double-tube structure is formed so that a radial distance between the inner bore tube and the outer bore tube at a certain position differs from the radial distance between the inner bore tube and the outer bore-tube at another position. A space formed, between the outer periphery of the inner bore tube and the inner periphery of the outer bore tube is located in a required size at an optimum position in accordance with flowing condition of water entering the throttle body. Thus, the water can be surely trapped in the space even if a flowing pattern or flowing quantity of the water flowing in from an upstream side or a downstream side of the throttle valve changes due to a change in a layout of an intake system of a vehicle, a mounting position of an ISC valve, or a mounting position of the throttle body to the vehicle. As a result, freezing of the throttle valve can be prevented without introducing engine cooling water.

According to another aspect of the present invention, the throttle body is formed in the double-tube structure, in which the inner bore tube is formed in the outer bore tube so that the central axis of the inner bore tube is deviated from the central axis of the outer bore tube. Thus, the radial size of the throttle body is reduced, so the throttle body is downsized.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENT (First Embodiment)

Figure 1:
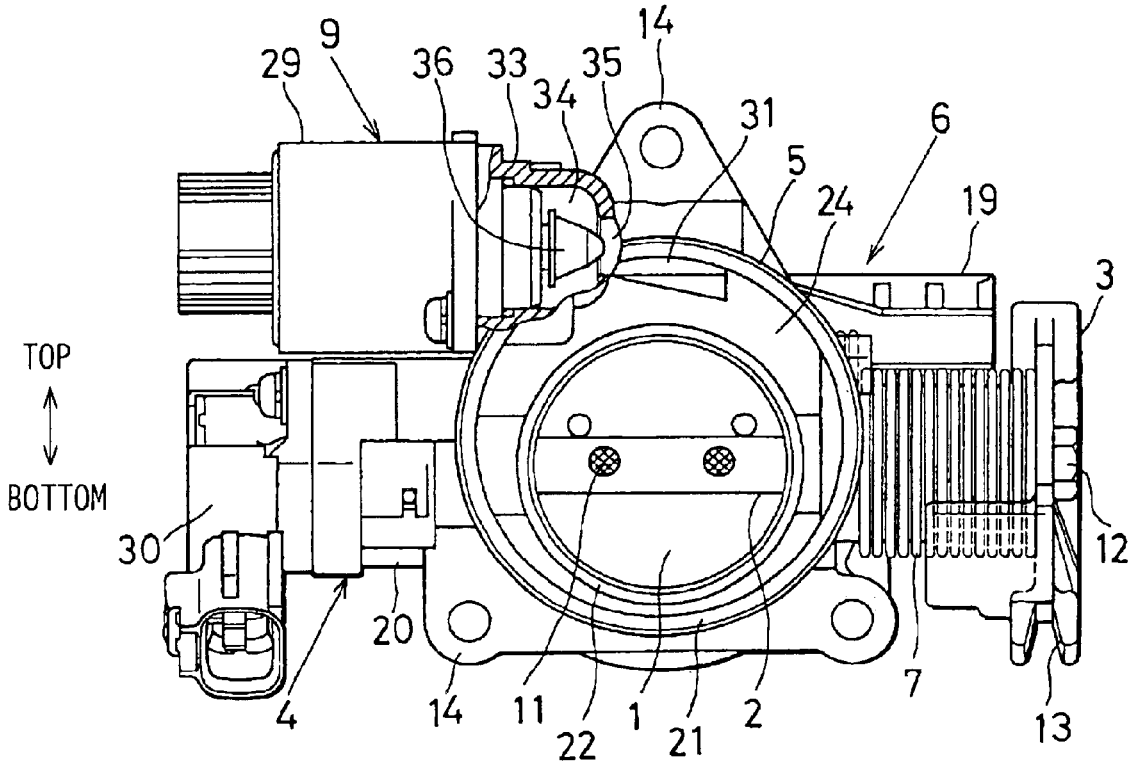
FIG. 1 is a schematic view showing a throttle valve system according to a first embodiment of the present invention.

Referring to FIG. 1, a throttle valve system according to the first embodiment of the present invention is illustrated.

The throttle valve system of the first embodiment controls quantity of intake air flowing into an internal combustion engine in accordance with a depressed degree of an accelerator pedal of an automotive vehicle. Thus, the throttle valve system controls engine speed. The throttle valve system has a throttle valve 1, a throttle valve shaft 2, a throttle lever 3, a throttle position sensor 4 and a throttle body 6. The throttle valve 1 controls the intake air quantity of the engine. The shaft 2 rotates integrally with the throttle valve 1. The throttle lever 3 drives the throttle valve 1 and the shaft 2. The throttle position sensor 4 detects a rotational angle of the throttle valve 1 and the shaft 2. The throttle body 6 has a cylindrical bore portion 5 for accommodating and holding the throttle valve 1 and the shaft 2 so that the throttle valve 1 can open or close.

Figure 2:
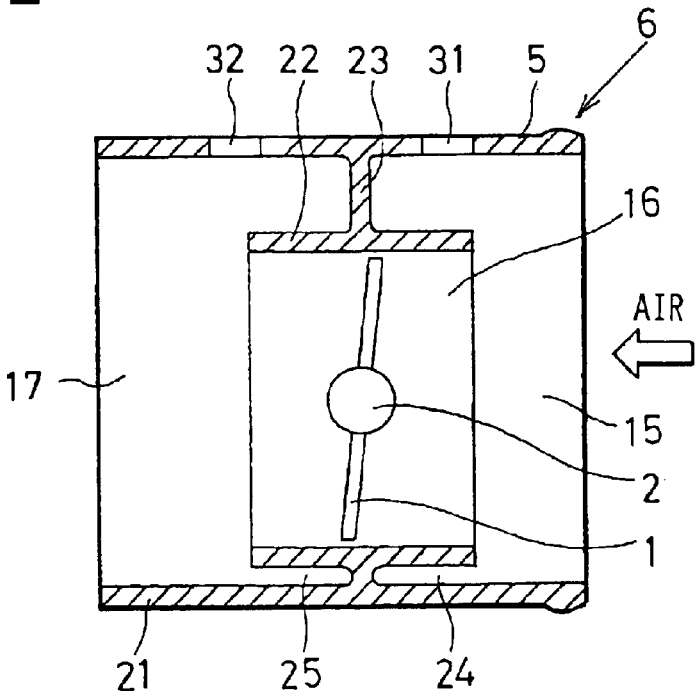
FIG. 2 is a sectional view showing a bore portion of a throttle body according to the first embodiment.

The throttle valve 1 is a butterfly-type rotary valve formed of metal material or resin material in the shape of a circular plate. The throttle valve 1 is inserted in valve insertion holes formed in the shaft 2. Then, the throttle valve 1 is fastened to the shaft 2 by fasteners 11 such as fastening screws. The shaft 2 is formed of metal material or resin material in the shape of a round bar. The shaft 2 is rotatably supported by bearing structure such as a thrust bearing, a dry bearing or a ball bearing in a bearing portion or a shaft through hole of the throttle body 6 as shown in FIGS. 1 and 2.

A throttle lever 3 is formed of metal material or resin material and is securely tightened to an end of the shaft 2, or a right end of the shaft 2 in FIG. 1, with a fastener 12 such as a bolt and a washer. A wire cable interlocked with the accelerator pedal is installed on a substantially V-shaped portion 13 of the throttle lever 3. A coil-like return spring 7 is installed between a left end of the throttle lever 3 and a right end of the throttle body 6 in FIG. 1. The return spring 7 moves the throttle lever 3 back to an initial position when the engine runs at an idling speed. One end of the return spring 7 is held on an outer periphery of the throttle lever 3 and the other end of the return spring 7 is held on an outer wall surface of the throttle body 6.

The throttle position sensor 4 is installed on the other end of the shaft 2, or a left end of the shaft 2 in FIG. 1. The throttle position sensor 4 has a rotor, a permanent magnet, a detection element such as a Hall element or a magnetic resistance element, and the like. The rotor of the throttle position sensor 4 is fastened to the left end of the shaft 2. The permanent magnet is mounted radially inside the rotor and rotates with the rotor. Thus, the permanent magnet functions as a magnetic field generating source. The detection element is disposed so that the detection element faces the permanent magnet. The detection element receives magnetic force from the permanent magnet to detect the rotational angle of the throttle valve 1. The throttle position sensor 4 detects an opening degree of the throttle valve 1 and the shaft 2 in the intake air passage connected to the engine. The throttle position sensor 4 converts the detected opening degree into an electric signal (a throttle opening degree signal), and sends the throttle opening degree signal to an engine control unit (ECU). The ECU determines the depressed degree of the accelerator pedal based on the throttle opening degree signal and uses the depressed degree as part of information for determining quantity of fuel to inject into the engine.

The throttle body 6 is formed of heat-resistant resin material in a single piece. The throttle body 6 is a device for holding the throttle valve 1 and the shaft 2. The throttle body 6 has a mounting flange portion 14 hermetically fixed to an engine intake manifold or a surge tank with fasteners such as bolts, nuts and other mounting metal fittings. A fully-closing stopper 19 is integrated with the outer peripheral surface of the throttle body 6 on the right side of the bore portion 5 in FIG. 1 so that the throttle lever 3 contacts the fully-closing stopper 19 when the throttle valve 1 closes fully.

A sensor accommodating portion 20 in the shape of a case is integrated with the outer peripheral surface of throttle body 6 on the left side of the bore portion 5 in FIG. 1. The sensor accommodating portion 20 accommodates components such as the rotor of the throttle position sensor 4. A sensor cover (a sensor main body) 30 is mounted on the sensor accommodating portion 20 with a fastener such as a bolt, a tightening screw, a tapping screw and the like. The sensor cover 30 blocks the opening side (a left side in FIG. 1) of the sensor accommodating portion 20 and fixedly holds the detection element and an external connection terminal of the throttle position sensor 4.

The bore portion 5 of the throttle body 6 is formed in double-tube structure, in which a cylindrical inner bore tube 22 is arranged within a cylindrical outer bore tube 22 as shown in FIGS. 1 and 2. As shown in FIG. 2, the outer bore tube 21 has an air inlet (intake air passage) 15 for drawing in the intake air from an air cleaner via an intake pipe, and an air outlet (intake air passage) 17 for supplying the intake air to the engine surge tank or the intake manifold. The outer bore tube 21 is formed of resin material in a single piece so that its internal diameter and its external diameter are generally constant along the intake airflow direction respectively.

The inner bore tube 22 is formed at the same time as the outer bore tube 21 when the outer bore tube 21 is formed of resin material. The inner bore tube 22 is formed so that a longitudinal length of the inner bore tube 22 along the airflow direction is shorter than that of the outer bore tube 21 as shown in FIG. 2. More specifically, the inner bore tube 22 is located between a position downstream from the air inlet 15 of the outer bore tube 21 by a predetermined distance and another position upstream from the air outlet 17 of the outer bore tube 21 by a predetermined distance as shown in FIG. 2. An intake air passage 16, through which the intake air flows to the engine, is formed inside the inner bore tube 22. The throttle valve 1 and the shaft 2 are rotatably installed at the middle of the longitudinal length of the inner bore tube 22 as shown in FIG. 2.

The annular space between the outer bore tube 21 and the inner bore tube 22 is divided by a partition wall 23 through the entire circumference substantially at the middle of the longitudinal length of the inner bore tube 22, or at a position where the shaft 2 is located. The upstream portion of the annular space upstream of the partition wall 23 serves as a trapping concavity (a water trapping groove) 24. The trapping concavity 24 traps the water flowing into the air inlet 15 of the outer bore tube 21 along the inner peripheral surface of the intake pipe. Thus, the trapping concavity 24 prevents the water from entering the inner bore tube 22, which accommodates the throttle valve 1.

On the other hand, the downstream portion of the annular space downstream of the partition wall 23 serves as a trapping concavity (water trapping groove) 25 for trapping the water flowing into the air outlet 17 of the outer bore tube 21 along the inner peripheral surface of the surge tank. Thus, the annular space can prevent the water from entering the inner bore tube 22. The trapping concavity 24 opens toward the upstream side from the throttle valve 1, while the trapping concavity 25 opens toward the downstream side from the throttle valve 1.

An air inlet port 31 and an air outlet port 32 are formed in the upper wall of the outer bore tube 21 as shown in FIG. 1 or 2. The air inlet port 31 communicates with the upstream portion of the annular space defined by the partition wall 23. The air outlet port 32 communicates with the downstream portion of the annular space defined by the partition wall 23. A bypass forming portion 33 is integrated with the outer periphery of the upper wall of the outer bore tube 21. The bypass forming portion 33 encloses the air inlet port 31 and the air outlet port 32 as shown in FIG. 1. A bypass 35 is formed in a space enclosed by the outer bore tube 21 and the bypass forming portion 33. The bypass 35 lets the air flow through the air inlet port 31, a passage 34 in the bypass forming portion 33 and the air outlet port 32, in that order.

The bypass 35 is an airflow channel bypassing the throttle valve 1. The bypass 35 connects the upstream side with the downstream side of the throttle valve 1. More specifically, the bypass 35 connects the trapping concavity 24 (the portion of the annular space upstream of the partition wall 23) with the trapping concavity 25 (the portion of the annular space downstream of the partition wall 23). An idling speed control valve (an ISC valve) 9 driven by a stepping motor 29 is fitted in the bypass 35. The ISC valve 9 regulates the quantity of air flowing through the bypass 35, in order to control the idling speed of the engine. An opening degree of the bypass 35 is regulated by a valve member 36 of the ISC valve 9. An outlet port of a positive crankcase ventilation system (PCV) or a purge tube for a transpiration control system may be provided in the upper wall of the outer bore tube 21 in FIGS. 1 and 2.

In the throttle body 6 of the present embodiment, the cylindrical inner bore tube 22 is off-centered with respect to the cylindrical outer bore tube 21 as shown in FIGS. 1 and 2. Thus, precedence is given to the prevention of the inflow of the water into the air inlet port 31 or the air outlet port 32 of the bypass 35. More specifically, the central axis of the inner bore tube 22 is deviated from that of the outer bore tube 21 downward by a predetermined distance as shown in FIG. 2. Thus, internal volume of the trapping concavities 24, 25 is made larger on the bypass 35 side (the upper wall side of the outer bore tube 21) than on the side opposite from the bypass 35 (the lower wall side of the outer bore tube 21). As a result, much water can be trapped (held) in the trapping concavities 24, 25 on the bypass 35 side, or on the upper wall side of the outer bore tube 21 in FIG. 2.

Next, operation of the throttle valve system of the first embodiment will be explained based on FIGS. 1 and 2.

If a vehicle driver depresses the accelerator pedal, the throttle lever 3, which is mechanically connected to the accelerator pedal through the wire cable, rotates by a rotational angle corresponding to the depressed degree of the accelerator pedal against the force of the return spring 7. Thus, the throttle valve 1 and the shaft 2 rotate by the same rotational angle as the throttle lever 3, and open the engine intake air passage 16 by a predetermined opening degree. Accordingly, the engine speed is changed to a speed corresponding to the depressed degree of the accelerator pedal.

On the contrary, if the vehicle driver takes off his foot from the accelerator pedal, the throttle valve 1, the shaft 2, the throttle lever 3, the wire cable and the accelerator pedal are moved back to their original positions (idling positions) by the force of the return spring 7. Thus, the intake air passage 16 of the engine is closed.

At this time, the intake air flows from the upstream side to the downstream side of the throttle valve 1 through the bypass 35 in accordance with the opening degree of the ISC valve 9. Since a predetermined quantity of the intake air is drawn into the engine, an air-fuel mixture is prevented from becoming too rich. Thus, an engine stall can be prevented. Meanwhile, the engine idling speed can be controlled to a target speed by regulating a setting position of the ISC valve 9. For instance, fuel mileage can be improved by setting the idling speed to a low value.

The throttle body 6 has the trapping concavities 24, 25 for preventing icing phenomenon during a cold period such as a winter season. The icing means a freezing phenomenon that the moisture included in the humid air is frozen because the intake air is partially cooled with vaporization heat of the fuel (gasoline), which is generated when the fuel vaporizes. More specifically, the icing is the phenomenon that the moisture included in the air attaches in the form of ice to the throttle valve 1 and the inner wall surface of the inner bore tube 22 near the throttle valve 1. This phenomenon is likely to occur particularly at high humidity and a low temperature around 5° C.

In order to prevent the icing phenomenon, the throttle body 6 has the double-tube structure in which the inner bore tube 22 is provided inside the outer bore tube 21. Moreover, the trapping concavity 24 opens toward the upstream side from the throttle valve 1 through the entire circumference of the inside of the throttle body 6. Therefore, the trapping concavity 24 can securely trap the water flowing from the upstream side of the throttle valve 1 along the inner peripheral surface of the intake pipe into the outer bore tube 21. Thus, the water is prevented from entering the inner bore tube 22, in which the throttle valve 1 is installed.

Furthermore, the trapping concavity 25 opens toward the downstream side from the throttle valve 1 through the entire circumference of the inside of the throttle body 6. Therefore, even if the water condensed in the surge tank flows to the outer bore tube 21 side of the throttle body 6, the water will flow into the trapping concavity 25 and will be trapped there. Thus, the water is prevented from entering the inner bore tube 22, in which the throttle valve 1 is installed.

As explained above, the throttle body 6 of the throttle valve system according to the first embodiment has the double-tube structure, in which the inner bore tube 22 accommodating the throttle valve 1 and the shaft 2 is provided inside the outer bore tube 21. The annular space (clearance) formed between the outer bore tube 21 and the inner bore tube 22 serves as the trapping concavities 24, 25 for trapping the water flowing into the bore portion 5 of the throttle body 6. Thus, the water is trapped and prevented from reaching the throttle valve 1.

The icing phenomenon of the throttle valve 1 during the cold period such as the winter season can be prevented without introducing engine cooling water into the throttle body 6 unlike conventional devices, because the water trapped in the trapping concavities 24, 25 is frozen there. More specifically, a trouble such as the icing at the throttle valve 1 and the inside wall surface of the inner bore tube 22 can be prevented. As a result, engine malfunction due to the icing can be prevented.

Depending on the type of the intake system of the vehicle, the flowing condition of the water to the bore portion 5 of the throttle body 6 or the mounting position of the bypass 35 of the ISC valve 9 vary. Therefore, the central axis of the inner bore tube 22 is deviated downward from the central axis of the outer bore tube 21 by a predetermined distance in accordance with the flowing condition of the water to the bore portion 5 and the mounting position of the bypass 35. Thus, the trapping concavities 24, 25 capable of trapping the required quantity of the water can be provided at the required positions. As a result, the downsizing of the bore portion 5 of the throttle body 6 can be achieved, and meanwhile, the performance for preventing the icing of the throttle valve 1 can be improved.

Since the bore portion 5 of the throttle body 6 is downsized, the cost of the material such as the resin or metal material required for integrally forming the throttle body 6 is decreased. Since the icing of the throttle valve 1 can be prevented without introducing the engine cooling water into the throttle body 6, a hot-water pipe for introducing the engine cooling water into the throttle body 6 may be eliminated. As a result, the cost is largely reduced in comparison with the conventional throttle valve system.

(Second Embodiment)

Figure 3:
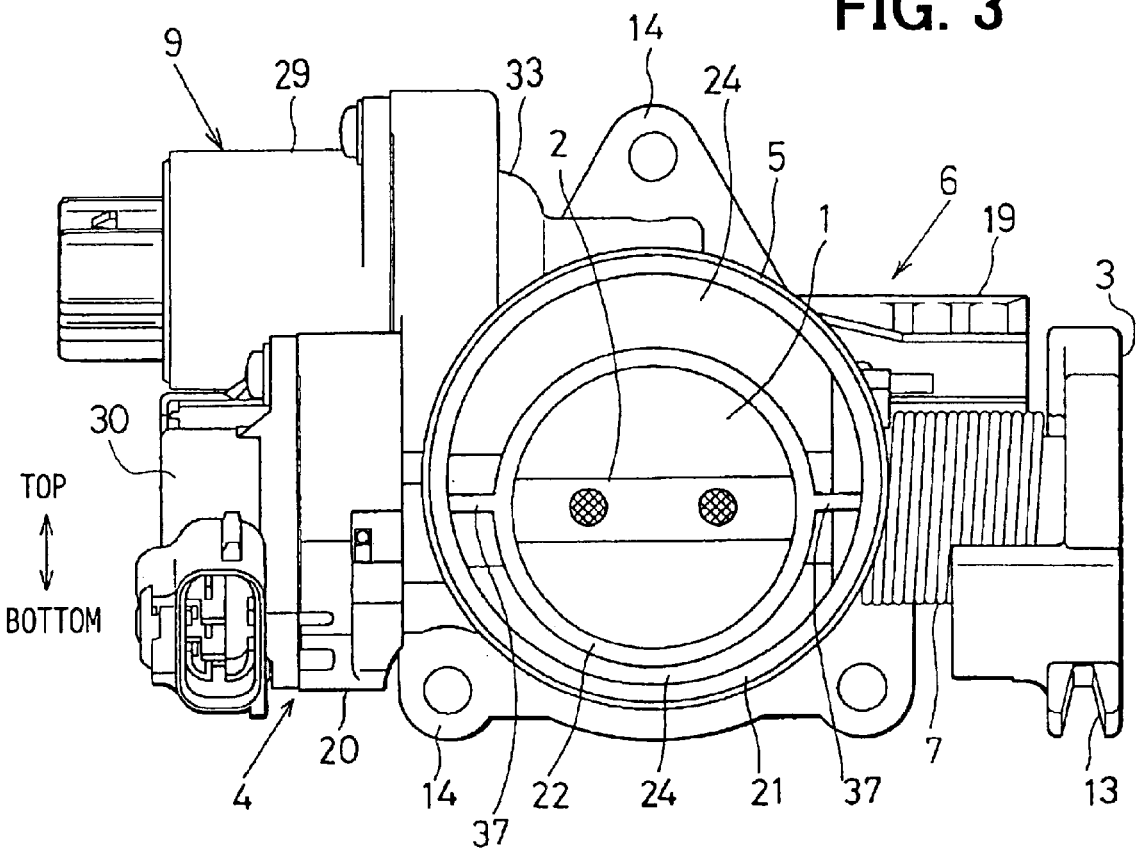
FIG. 3 is a schematic view showing a throttle valve system according to a second embodiment of the present invention.

Next, a throttle valve system according to the second embodiment of the present invention will be explained based on FIGS. 3 and 4.

The bore portion 5 of the throttle body 6 of the present embodiment has double-tube structure integrally formed of heat-resistant resin, like the first embodiment. The inner bore tube 22 is formed radially inside the outer bore tube 21 as shown in FIG. 4. The longitudinal length of the inner bore tube 22 along the airflow direction is shorter than the outer bore tube 21. The inner bore tube 22 is off-centered with respect to the outer bore tube 21. Furthermore, partition walls 37 are integrated with the bore portion 5 of the throttle body 6 for bridging the inner periphery of the outer bore tube 21 and the outer periphery of the inner bore tube 22. The partition walls 37 are provided on both sides of the inner bore tube 22 in a plane extending horizontally from the central axis of the inner bore tube 22. Each partition wall 37 is formed in the same length as the inner bore tube 22 in the airflow direction, and is formed slightly shorter than the outer bore tube 21 in the airflow direction. The partition wall 37 may be inclined by a predetermined angle toward the top or bottom side in FIG. 4 with respect to the airflow direction. The partition wall 23 defines the annular space provided between the outer bore tube 21 and the inner bore tube 22 through the entire circumference as shown in FIG. 4. Only the annular space upstream of the partition wall 23 provides the trapping concavity 24, which traps the water flowing into the outer bore tube 21 along the inner peripheral surface of the intake pipe. The trapping concavity 24 opens toward the upstream side from the throttle valve 1, and is divided into an upper portion and a lower portion by the partition wall 37 as shown in FIG. 4.

Figure 4:
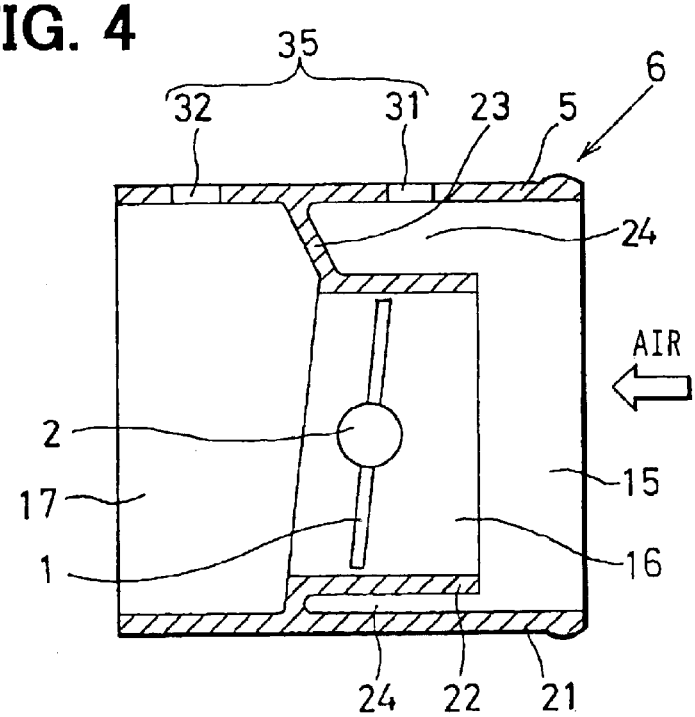
FIG. 4 is a sectional view showing a bore portion of a throttle body according to the second embodiment.

The radially outer portion of the partition wall 23 is inclined toward the downstream side along the airflow direction in comparison with its radially inner portion as shown in FIG. 4. More specifically, the radially outer portion of the partition wall 23 is deviated downstream along the airflow direction in comparison with its radially inner portion as shown in FIG. 4. The radial length of the trapping concavity 24 is formed larger on the upper side than on the lower side as shown in FIG. 4. Therefore, the air inlet port 31 and the air outlet port 32 of the bypass 35, whose opening degree is adjusted by the ISC valve 9, can be formed easily in the upper wall of the outer bore tube 21 as shown in FIG. 4.

(Third Embodiment)

Figure 5:
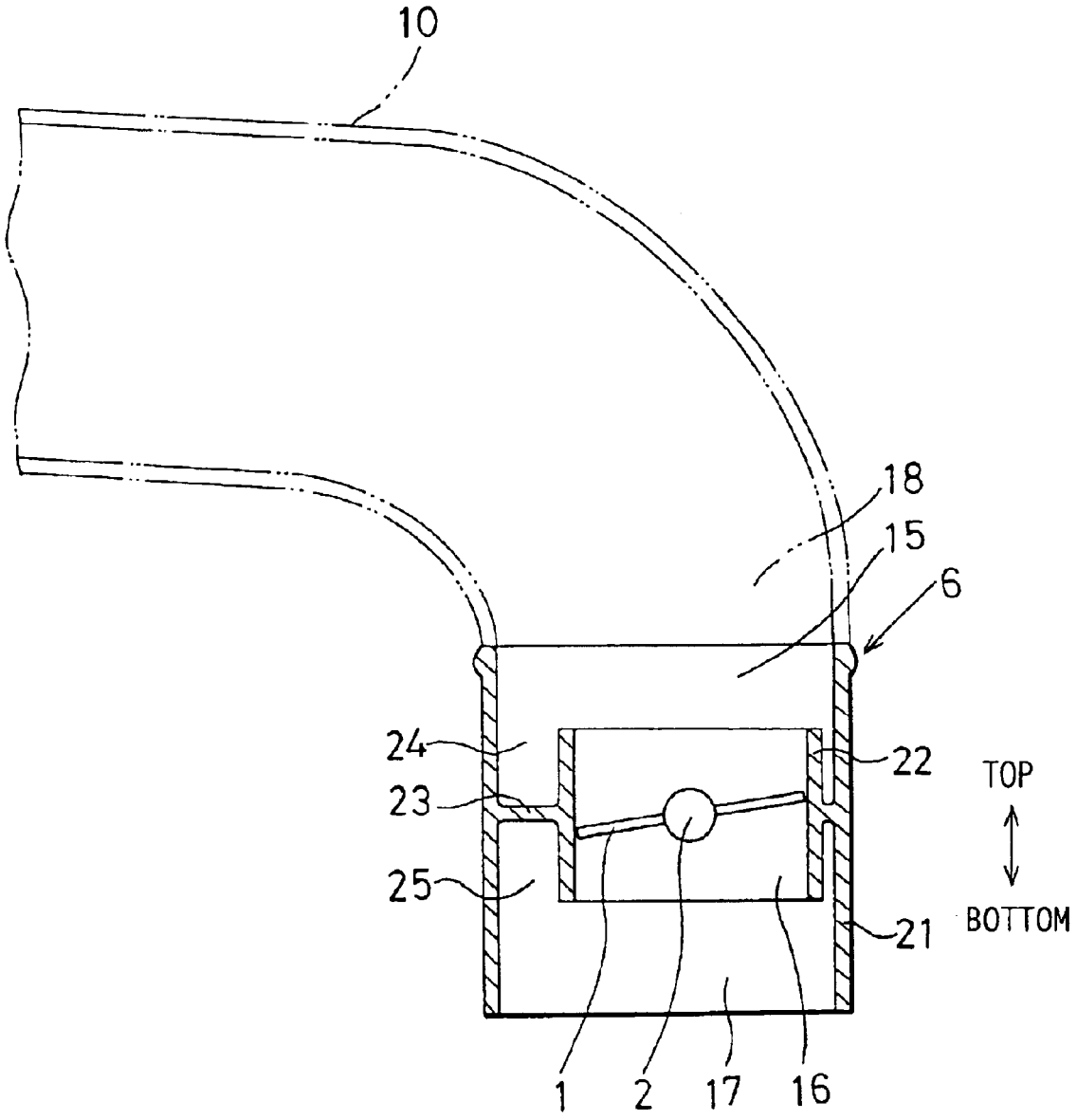
FIG. 5 is a sectional view showing a bore portion of a throttle body according to a third embodiment of the present invention.

Next, a throttle valve system according to the third embodiment of the present invention will be explained based on FIG. 5.

In an intake system of a vehicle of the third embodiment, an air cleaner is air-tightly connected to the air inlet 15 of the outer bore tube 21 of the throttle body 6. The throttle body 6 is placed below an air outlet 18 of the intake pipe 10, through which the intake air flows, as shown in FIG. 5. More specifically, the throttle body 6 is disposed so that the opening side of the trapping concavity 24 (the annular space upstream of the partition wall 23) faces upward in FIG. 5. Meanwhile, the throttle body 6 is disposed so that the opening side of the trapping concavity 25 (the annular space downstream of the partition wall 23) is directed downward in FIG. 5. Thus, the throttle body 6 is mounted on the vehicle so that a relatively wide portion of the trapping concavity 24 is located on the side where the water runs along the inner peripheral surfaces of the intake pipe 10 and the air inlet 15 of the outer bore tube 21.

(Fourth Embodiment)

Figure 6:
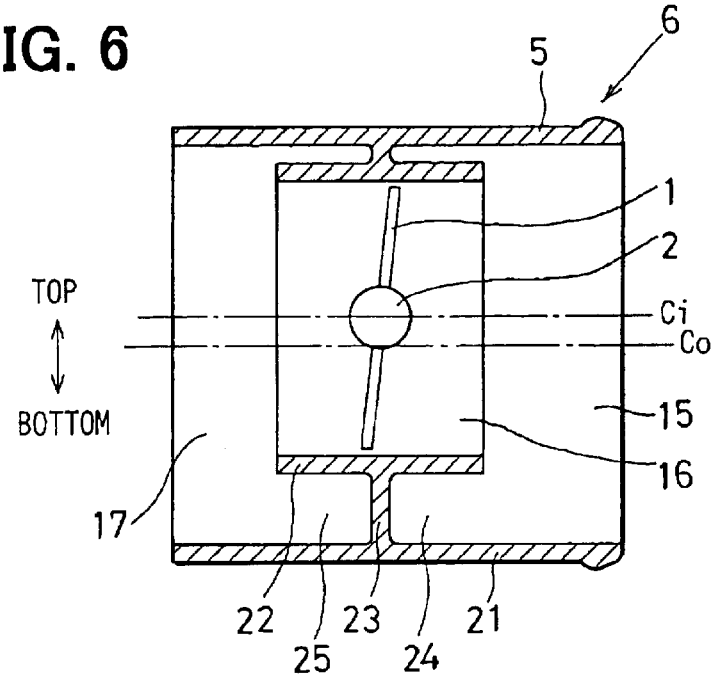
FIG. 6 is a sectional view showing a bore portion of a throttle body according to a fourth embodiment of the present invention.

Next, a throttle valve system according to the fourth embodiment of the present invention will be explained based on FIG. 6.

In the fourth embodiment, the ISC valve is not fitted to the throttle body 6, unlike the first and second embodiments. The bore portion 5 of the throttle body 6 is formed in the double-tube structure, in which the cylindrical inner bore tube 22 is disposed inside the cylindrical outer bore tube 21 so that the central axis $C_i$ of the inner bore tube 22 is deviated upward from the central axis $C_o$ of the outer bore tube 21 as shown in FIG. 6. Thus, the trapping concavities 24, 25 having large internal volume on the lower side are provided. In this structure, large quantity of the water can be trapped in the trapping concavity 24 even when large quantity of the water flows into the air inlet 15 of the outer bore tube 21 along the inner peripheral surface of the intake pipe.

(Fifth Embodiment)

Next, a throttle valve system according to the fifth embodiment of the present invention will be explained based on FIGS. 7, 8A, and 8B.

Figure 7:
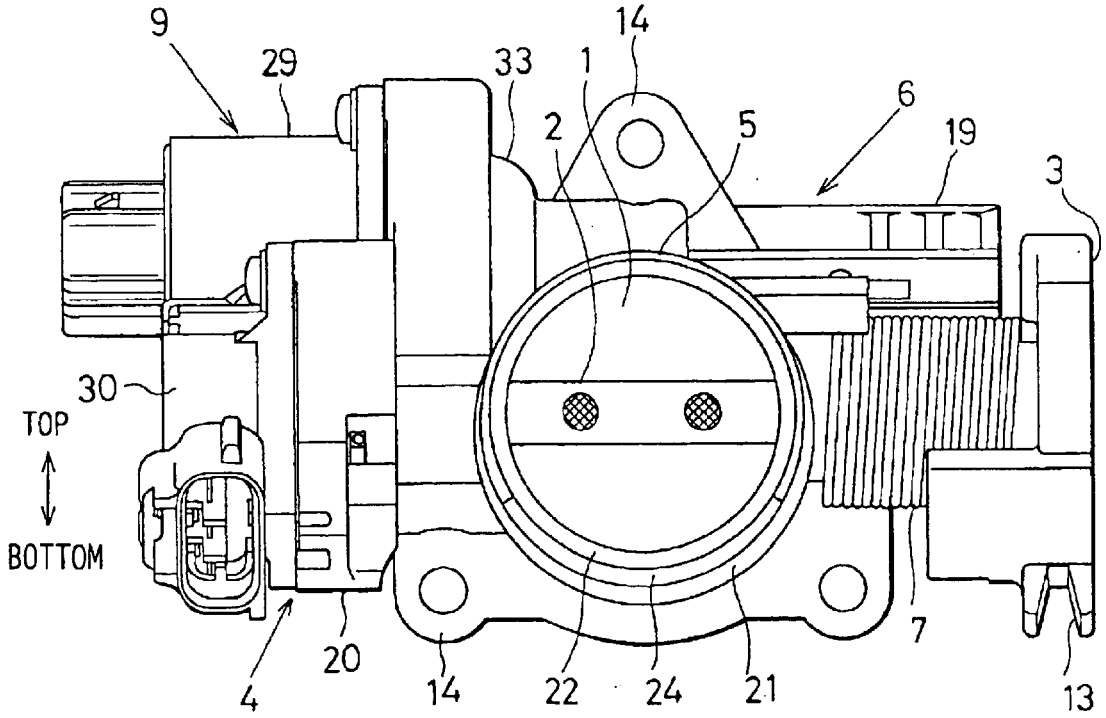
FIG. 7 is a schematic view showing a throttle valve system according to a fifth embodiment of the present invention.
Figure 8A:
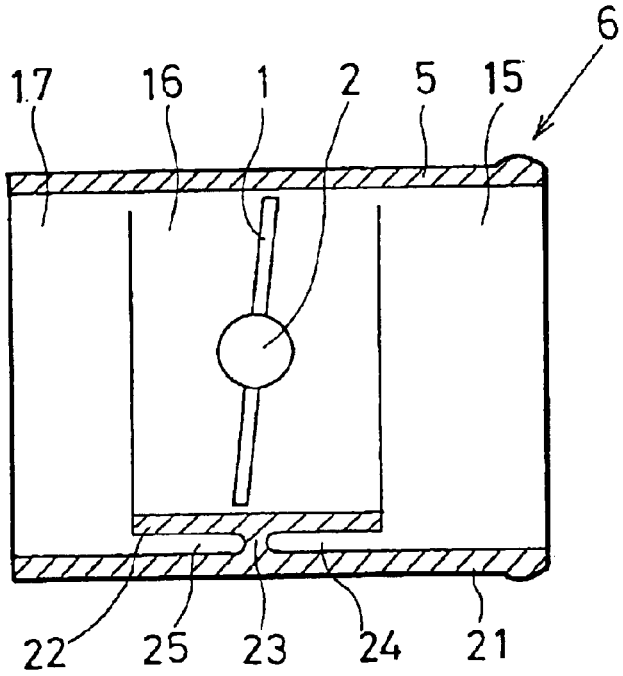
FIG. 8A is a sectional view showing a bore portion of a throttle body according to the fifth embodiment.

The bore portion 5 of the throttle body 6 of the fifth embodiment is formed in partial double-tube structure, in which a cylindrical inner bore tube 22 is disposed inside the cylindrical outer bore tube 21, and the inner bore tube 22 and the outer bore tube 21 partially share a peripheral wall on the upper side as shown in FIGS. 7 and 8A. In the throttle body 6, the cylindrical inner bore tube 22 is off-centered with respect to the cylindrical outer bore tube 21. More specifically, the central axis of the inner bore tube 22 is deviated upward from the central axis of the outer bore tube 21. Thus, the trapping concavities 24, 25 have larger internal volume on the lower wall side of the outer bore tube 21 than on the upper wall side of the outer bore tube 21 as shown in FIG. 8A, for the purpose of holding the water on the lower side.

Figure 8B:
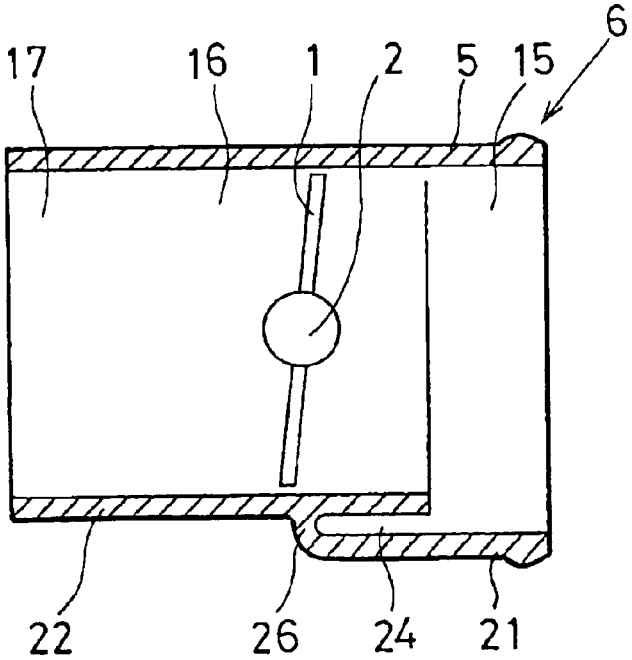
FIG. 8B is a sectional view showing a modified example of the bore portion of the throttle body according to the fifth embodiment.

Alternatively, in the fifth embodiment, the bore portion 5 of the throttle body 6 may be formed in another type of partial double-tube structure, in which a part of the cylindrical inner bore tube 22 upstream of the throttle valve 1 is disposed inside the cylindrical outer bore tube 21 as shown in FIGS. 7 and 8B. A part of the throttle body 6 on the downstream side of the throttle valve 1 is provided only by the cylindrical inner bore tube 22. A crescent space formed between the outer bore tube 21 and the inner bore tube 22 is closed by an extension wall (a partition wall) 26, which integrally extends toward the outer bore tube 21 from a line, which circumferentially runs on the outer peripheral surface of the inner bore tube 22 and intersects the rotational axis of the shaft 2. Only a part of the crescent space upstream of the extension wall 26 functions as the trapping concavity 24 for trapping the water flowing into the outer bore tube 21 along the inner peripheral surface of the intake pipe. The trapping concavity 24 opens toward the upstream side from the throttle valve 1.

(Sixth Embodiment)

Next, a throttle valve system according to the sixth embodiment of the present invention will be explained based on FIGS. 9, 10A, 10B and 10C.

Figure 9:
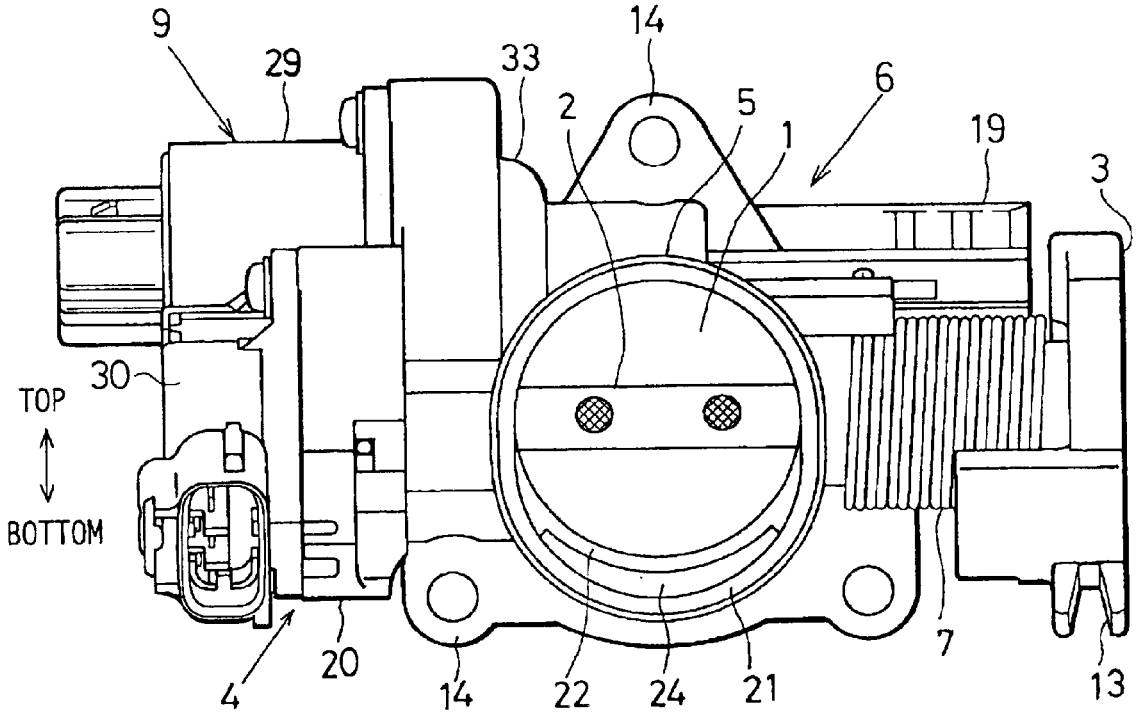
FIG. 9 is a schematic view showing a throttle valve system according to a sixth embodiment of the present invention.
Figure 10A:
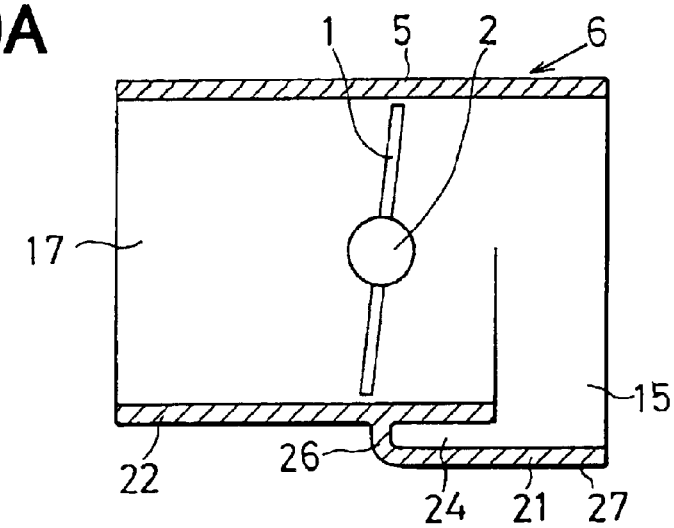
FIG. 10A is a sectional view showing a bore portion of a throttle body according to the sixth embodiment of the present invention.

The bore portion 5 of the throttle body 6 of the sixth embodiment is formed in partial double-tube structure, in which a part of the cylindrical inner bore tube 22 upstream of the throttle valve 1 is disposed inside an elliptical tube-shaped outer bore tube 21 as shown in FIGS. 9 and 10A. In the throttle body 6, the cylindrical inner bore tube 22 is off-centered with respect to the elliptical tube-shaped outer bore tube 21. More specifically, the central axis of the inner bore tube 22 is deviated upward from the central axis of the outer bore tube 21 as shown in FIGS. 9 and 10A. In the sixth embodiment, the throttle body 6 on the downstream side of the throttle valve 1 is provided only with the cylindrical inner bore tube 22.

A crescent space formed between the outer bore tube 21 and the inner bore tube 22 is closed by the extension wall (the partition wall) 26 integrally extending toward the outer bore tube 21 from a line, which circumferentially runs on the outer peripheral surface of the inner bore tube 22 and intersects the rotational axis of the shaft 2. Only a part of the crescent space upstream of the extension wall 26 provides the trapping concavity 24 for trapping the water flowing along the inner peripheral surface of the intake pipe into the outer bore tube 21. The trapping concavity 24 opens toward the upstream side from the throttle valve 1. A mounting seal portion 27 is provided on the right end of the outer bore tube 21 of the throttle body 6 for mounting the throttle body 6 air-tightly to a coupling end surface of the intake pipe as shown in FIG. 10A. The sealing surface of the mounting seal portion 27 is the outer peripheral surface of the mounting seal portion 27.

Figure 10B:
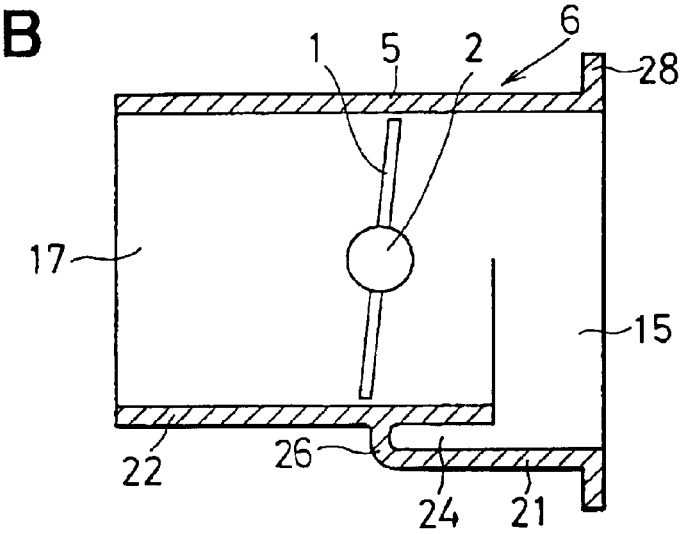
FIG. 10B is a sectional view showing a modified example of the bore portion of the throttle body according to the sixth embodiment of the present invention.

Alternatively, in the sixth embodiment, a mounting flange portion 28 may be provided on the right end of the outer bore tube 21 of the throttle body 6 for mounting the throttle body 6 air-tightly to a coupling end surface of the intake pipe as shown in FIG. 10B. The sealing surface of the mounting flange portion 28 is the right end surface of the mounting flange portion 28 in FIG. 10B.

Figure 10C:
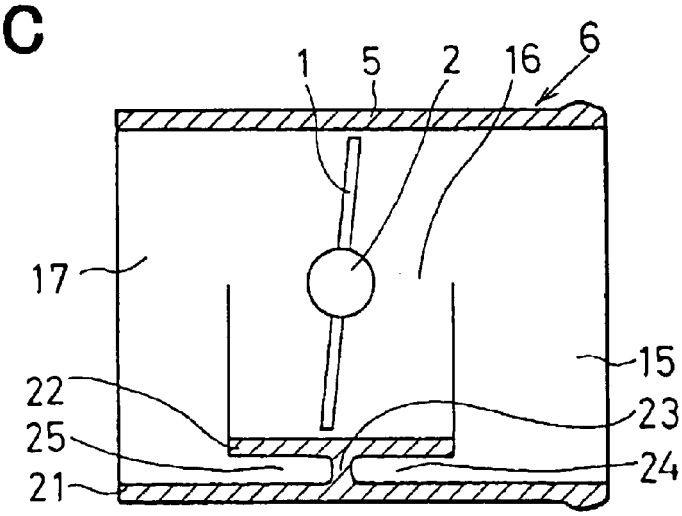
FIG. 10C is a sectional view showing another modified example of the bore portion of the throttle body according to the sixth embodiment of the present invention.

Alternatively, the bore portion 5 of the throttle body 6 of the sixth embodiment may be formed in another type of partial double-tube structure, in which a cylindrical inner bore tube 22 is disposed inside the elliptical tube-shaped outer bore tube 21, and the inner bore tube 21 and the outer bore tube 22 share a part of the peripheral wall as shown in FIGS. 9 and 10C. In the throttle body 6, the cylindrical inner bore tube 22 is off-centered with respect to the elliptical tube-shaped outer bore tube 21. More specifically, the central axis of the inner bore tube 22 is deviated upward from the central axis of the outer bore tube 21 as shown in FIGS. 9 and 10C. Therefore, the trapping concavities 24, 25 have larger internal volume on the lower wall side of the outer bore tube 21 than on the upper wall side of the outer bore tube 21 as shown in FIGS. 9 and 10C.

(Seventh Embodiment)

Next, a throttle valve system according to the seventh embodiment of the present invention will be explained based on FIGS. 11 and 12.

Figure 11:
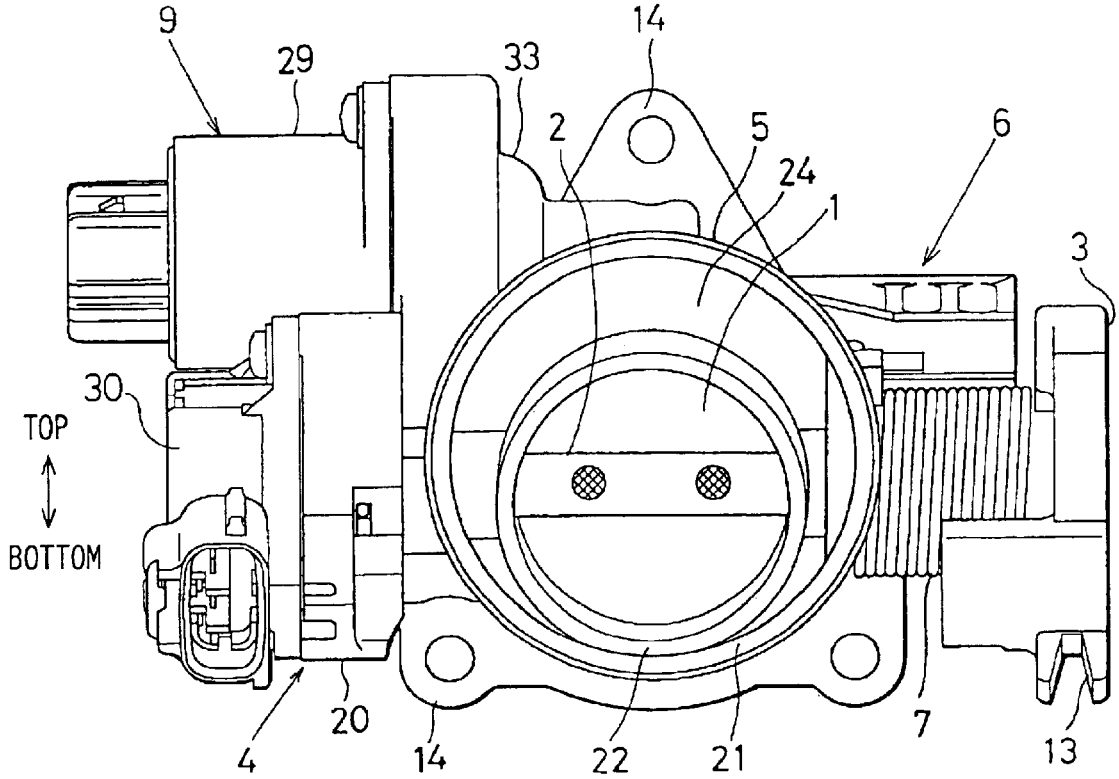
FIG. 11 is a schematic view showing a throttle valve system according to a seventh embodiment of the present invention.
Figure 12:
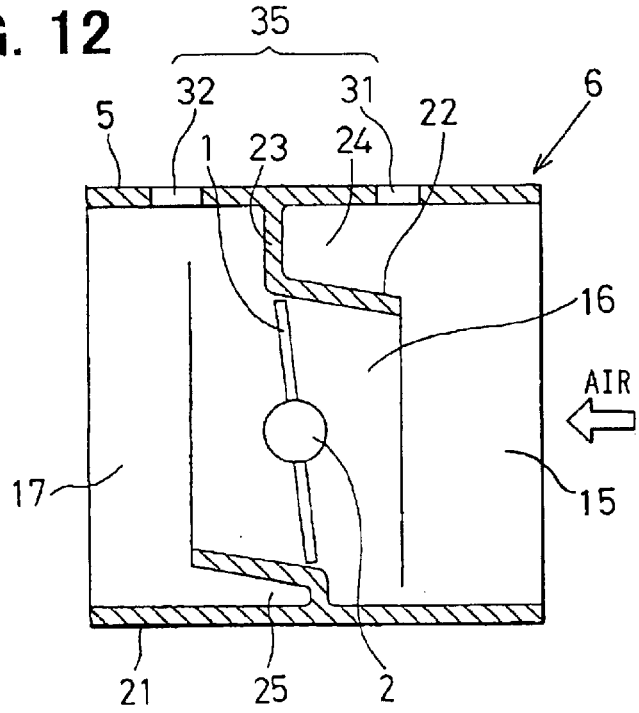
FIG. 12 is a sectional view showing a bore portion of a throttle body according to the seventh embodiment.
Figure 13:
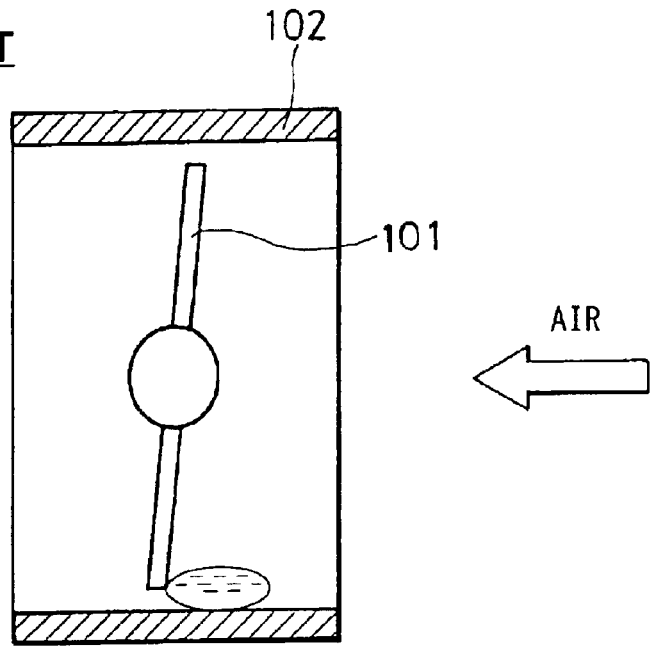
FIG. 13 RELATED ART
FIG. 13 is a schematic view showing a bore portion of a throttle body of a related art.
Figure 14:
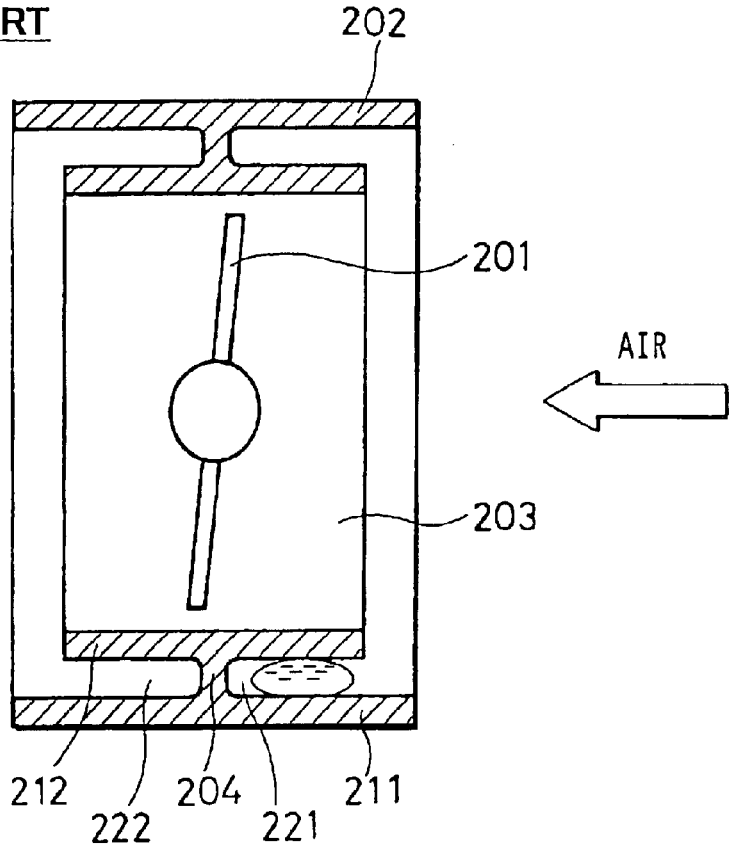
FIG. 14 RELATED ART
FIG. 14 is a schematic view showing a bore portion of a throttle body of another related art.

In the seventh embodiment, the bore portion 5 of the throttle body 6 is formed in partial double-tube structure, in which the inner bore tube 22 accommodating the throttle valve 1 and the shaft 2 is disposed inside the outer bore tube 21, and the inner bore tube 22 and the outer bore tube 21 share a part of an outer peripheral wall as shown in FIGS. 11 and 12. A part of a crescent space formed between the outer bore tube 21 and the inner bore tube 22 upstream of the partition wall 23, which is provided mainly on the upper side in FIG. 12, provides the trapping concavity 24. On the other hand, another part of the crescent space downstream of the partition wall 23, which is provided mainly on the lower side in FIG. 12, provides the trapping concavity 25.

In the bore portion 5 of the throttle body 6, the cylindrical inner bore tube 22 is off-centered with respect to the cylindrical outer bore tube 21 as shown in FIGS. 11 and 12. More specifically, the central axis of the inner bore tube 22 is deviated downward from the central axis of the outer bore tube 21 to prevent the entry of the water into the air inlet port 31 or the air outlet port 32 of the bypass 35 of the ISC valve 9. Thus, the internal volume of the trapping concavity 24 is larger on the bypass 35 side (on the upper wall side of the outer bore tube 21) than on the opposite side from the bypass 35 (on the lower wall side of the outer bore tube 21) as shown in FIG. 12.

The upper portion of the inner bore tube 22 extends toward the upstream side of the airflow direction from the inner periphery of the partition wall 23 as shown in FIG. 12. Meanwhile, the upper portion of the inner bore tube 22 is inclined by a predetermined angle toward the central axis of the inner bore tube 22 with respect to the airflow direction as shown in FIG. 12. The lower portion of the inner bore tube 22 extends toward the downstream side of the airflow direction from the inner periphery of the partition wall 23 as shown in FIG. 12. Meanwhile, the lower portion of the inner bore tube 22 of the throttle body 6 is inclined by a predetermined angle toward the central axis of the inner bore tube 22 with respect to the airflow direction as shown in FIG. 12.

Therefore, the opening degree of the trapping concavity 24 provided on the upper side gradually increases toward the upstream side from the throttle valve 1. Thus, the trapping concavity 24 can trap larger quantity of the water than the first embodiment. The opening degree of the trapping concavity 25 provided on the lower side increases toward the downstream side from the throttle valve 1. Thus, the trapping concavity 25 can prevent the water from entering the air outlet port 32 of the bypass 35 of the ISC valve 9 more effectively than the first embodiment.

(Modifications)

In the embodiments, the throttle valve 1 is operated by mechanically transmitting the depressed degree of the accelerator pedal to the throttle lever 3 and the shaft 2 through the wire cable. Alternatively, a valve gear may be driven by a motor through a reduction gear mechanism to operate the throttle valve 1 and the shaft 2. In this case, the valve gear may be fastened to the end of the shaft 2 by the use of a fastener such as a screw, or the valve gear may be integrated with the end of the shaft 2.

In the embodiments, the air inlet port 31 or the air outlet port 32 of the bypass 35, whose opening degree is controlled by the valve body 36 of the ISC valve 9, is provided on the topside of the outer bore tube 21 of the throttle body 6. Alternatively, the air inlet port 31 or the air outlet port 32 may be provided on the lower side or a side in the horizontal direction of the outer bore tube 21.

An outlet port of the crankcase emission control channel, whose opening degree is controlled by a PCV valve, may be provided in the intake pipe of the engine. The PCV valve is a flow control valve used in the positive crankcase ventilation system. The positive crankcase ventilation system recirculates blow-by gas from the crankcase to the intake system such as the intake manifold or the air cleaner to perform re-combustion of the blow-by gas. Furthermore, the outlet port of the positive crankcase ventilation system (PCV) or the purge tube for the transpiration control system may be provided in the upper wall of the outer bore tube 21.

In the embodiments, the throttle body 6 is integrally formed of heat-resistant resin material. Alternatively, the throttle body 6 may be integrally formed of aluminum die-cast metal or metal material. In the embodiments, the throttle valve 1 and the shaft 2 are made of metal material. Alternatively, the throttle valve 1 and the shaft 2 may be integrally formed of heat-resistant resin material.

In the fifth and sixth embodiments, the trapping concavity 24 made of a heat-resistant resin material is formed only on the lower side of the throttle body 6, so the trapping concavity 24 opens toward the upstream side from the throttle valve 1. Alternatively, the trapping concavity 25 made of heat-resistant resin material, aluminum die-cast metal or metal material may be formed only on the lower side of the throttle body 6, so the trapping concavity 25 opens toward the downstream side from the throttle valve 1.

The present invention should not be limited to the disclosed embodiments, but may be implemented in many other ways without departing from the spirit of the invention.

What is claimed is:

1. A throttle valve system of an internal combustion engine, the throttle valve system comprising:

a throttle valve for controlling a flow rate of intake air to be drawn into the engine;

a throttle body having an outer bore tube and an inner bore tube accommodating the throttle valve so that the throttle valve can open or close, wherein the throttle valve system is formed with an annular trapping space between the outer periphery of the inner bore tube and an inner periphery of the outer bore tube for trapping water entering the throttle body, the annular trapping space is separated by a partition wall through an entire circumference of the inner bore tube, the partition wall defines a trapping concavity for trapping the water, which flows in from an upstream side of the throttle valve, at least in a portion of the annular space upstream of the partition wall, and the throttle body is formed in double-tube structure, in which the outer bore tube circumferentially surrounds an outer periphery of the inner bore tube, a radial distance between the inner bore tube and the outer bore tube at a certain position differs from the radial distance between the inner bore tube and the outer bore tube at another position, and a central axis of the inner bore tube is deviated from a central axis of the outer bore tube.

2. The throttle valve system of the internal combustion engine as in claim 1, wherein the trapping space is formed in a required size and a position corresponding to a mounting position of the throttle body.

3. The throttle valve system of the internal combustion engine as in claim 1, wherein the throttle body is formed so that the inner bore tube is formed in the shape of a cylindrical tube and the outer bore tube is formed in the shape of an elliptical tube or an oblong tube.

4. The throttle valve system of the internal combustion engine as in claim 1, wherein the inner bore tube is inclined with respect to a direction of flow of the intake air.

5. The throttle valve system of the internal combustion engine as in claim 1, wherein the trapping space is formed in a shape and a size corresponding to a layout of an intake system of a vehicle or a mounting position of the throttle body.

6. The throttle valve system of the internal combustion engine as in claim 1, wherein the trapping space has a larger radial width on a side where a flow control valve for a positive crankcase ventilation system or an idling speed control valve is mounted than on another side where the flow control valve or the idling speed control valve is not mounted.

7. The throttle valve system of the internal combustion engine as in claim 1, wherein the trapping space has a larger radial width on a lower side than on an upper side when the throttle valve system is mounted to the engine.

* * * * *